US009580156B2

(12) United States Patent
Wittenberg et al.

(10) Patent No.: US 9,580,156 B2
(45) Date of Patent: Feb. 28, 2017

(54) FLOATING DOCK

(75) Inventors: Daniel Wittenberg, Delta (CA); Lockhart Gordon McCallum, Delta (CA); Robert William Richard Field, Delta (CA)

(73) Assignee: 0926084 B.C. Ltd., Delta (CA)

( * ) Notice: Subject to any disclaimer, the term of this patent is extended or adjusted under 35 U.S.C. 154(b) by 63 days.

(21) Appl. No.: 14/421,753

(22) PCT Filed: Aug. 15, 2012

(86) PCT No.: PCT/CA2012/050555

§ 371 (c)(1),
(2), (4) Date: May 21, 2015

(87) PCT Pub. No.: WO2014/026265

PCT Pub. Date: Feb. 20, 2014

(65) Prior Publication Data

US 2015/0307170 A1 Oct. 29, 2015

(51) Int. Cl.

| | |
|---|---|
| ***B63C 1/02*** | (2006.01) |
| ***E02B 3/06*** | (2006.01) |
| ***B28B 23/00*** | (2006.01) |
| ***B63B 35/44*** | (2006.01) |

(52) U.S. Cl.

CPC ..... *B63C 1/02* (2013.01); *B28B 23/0056* (2013.01); *B63B 35/44* (2013.01); *E02B 3/064* (2013.01); *B63B 2231/64* (2013.01)

(58) Field of Classification Search

CPC ..... B63C 1/02

USPC ..... 114/263

See application file for complete search history.

(56) References Cited

U.S. PATENT DOCUMENTS 3,323,479 A * 6/1967 Filak ..... B63B 9/00 114/266
3,861,340 A * 1/1975 Clingenpeel ..... B63B 35/34 114/267
3,977,344 A * 8/1976 Holford ..... E02B 3/064 114/263
4,041,716 A * 8/1977 Thompson ..... E02B 3/064 114/266
4,223,629 A * 9/1980 Dunlop ..... E02B 3/064 114/263
4,260,293 A * 4/1981 Peterson ..... E02B 3/064 114/267
4,263,862 A * 4/1981 Shepherd ..... B63B 5/14 114/65 A
4,316,426 A * 2/1982 Meeusen ..... E02B 3/068 114/263
4,318,361 A * 3/1982 Sluys ..... B63B 5/14 114/263
4,318,362 A * 3/1982 Jung ..... B63B 5/20 114/263
4,365,914 A * 12/1982 Sluys ..... E02B 3/064 114/267
4,559,891 A * 12/1985 Shorter, Jr. ..... B63B 35/34 114/263

(Continued)

*Primary Examiner* — Lars A Olson
*Assistant Examiner* — Jovon Hayes
(74) *Attorney, Agent, or Firm* — Oyen Wiggs Green & Mutala LLP

(57) ABSTRACT

A floating dock is provided. The floating dock has a buoyant core. The sidewalls of the buoyant core have grooves. A reinforcing truss is embedded in and extends through the grooves. The grooves may be filled with concrete.

16 Claims, 13 Drawing Sheets

(56) References Cited

U.S. PATENT DOCUMENTS

| | | | | | |
|---|---|---|---|---|---|
| 4,660,495 | A * | 4/1987 | Thompson | E02B 3/064 | 114/263 |
| 4,709,647 | A * | 12/1987 | Rytand | E02B 3/064 | 114/263 |
| 4,887,654 | A * | 12/1989 | Rytand | E02B 3/064 | 114/263 |
| 5,107,785 | A * | 4/1992 | Baxter | B63B 35/34 | 114/266 |
| 5,215,027 | A * | 6/1993 | Baxter | B63B 35/34 | 114/266 |
| 5,845,594 | A * | 12/1998 | Hallsten | B63B 35/38 | 114/263 |
| 7,273,018 | B2 * | 9/2007 | Strong | E02B 3/064 | 114/266 |
| 7,845,300 | B1 * | 12/2010 | Stroud | B63B 35/44 | 114/263 |
| 9,206,570 | B2 * | 12/2015 | Knight | B63B 3/08 | |
| 2005/0284088 | A1 * | 12/2005 | Heath | E04B 2/845 | 52/741.1 |
| 2006/0016146 | A1 * | 1/2006 | Heath | E04C 2/049 | 52/633 |
| 2015/0307170 | A1 * | 10/2015 | Wittenberg | E02B 3/064 | 114/263 |

* cited by examiner

FLOATING DOCK

REFERENCE TO RELATED APPLICATIONS

This application is a 371 of Patent Cooperation Treaty international application No. PCT/CA2012/050555 filed 15 Aug. 2012, which is incorporated by reference herein.

TECHNICAL FIELD

This invention relates to floating docks.

BACKGROUND

Floating docks formed from a buoyant core with a concrete shell are known. Concrete is a favoured material for floating docks because of its strength and durability compared to other materials such as wood. The concrete is typically reinforced with steel reinforcement bars (rebar) to improve its strength. A problem with rebar is that it can corrode due to contact with sea water that gradually infiltrates through the concrete shell. Rebar corrosion can lead to concrete failure. To prevent corrosion, concrete must typically be provided in a layer at least three inches thick between the rebar and the outer surface of the floating dock. However, providing a thick layer of concrete, which raises material costs. A thick layer of concrete also adds significant weight to the floating dock, which must be compensated for in order to maintain buoyancy by making the floating dock larger. While one solution to the problem of corrosion is to use stainless steel rebar or epoxy-coated rebar such alternatives are costly. There is a need for a lightweight yet strong concrete floating dock that reduces material costs while providing strength and durability.

SUMMARY

In one aspect, a floating dock is provided. The dock comprises a buoyant core having sidewalls with concrete-filled grooves; and a reinforcing truss embedded in and extending along a path defined by the concrete-filled grooves. The reinforcing truss may comprise reinforcement steel bars. The concrete-filled grooves may be approximately 2 to 4 inches (51 to 102 mm) deep, or be approximately 3 inches (76 mm) deep. The reinforcing truss may be selected from the group consisting of simple, lattice, Howe, Warren, Pratt, King post, Fink, Vierendeel, palladian, and grid trusses. The reinforcing truss may be a simple truss. The simple truss may span the height of the sidewalls of the buoyant core. The buoyant core may comprise expanded polystyrene foam. The buoyant core may be shaped as a rectangular prism. The buoyant core may have a bottom with concrete-filled grooves, and reinforcement steel bars embedded in and extending along a path defined by the concrete-filled grooves of the bottom. The reinforcement steel bars embedded in and extending along the path defined by the concrete-filled grooves of the bottom may connect to the reinforcement steel bars embedded in and extending along a path defined by the concrete-filled grooves of the sidewalls. The may comprise a deck, which may comprise concrete reinforced with a grid of reinforcement steel bars. The grid of reinforcement steel bars reinforcing the concrete of the deck may connect to the reinforcement steel bars embedded in and extending along the path defined by the concrete-filled grooves of the sidewalls. The dock may comprise connectors for connecting to one or more other floating docks. The connectors may comprise a pair of parallel channels formed at one end of the floating dock.

In another aspect, a method of constructing a floating dock is provided. The method comprising the steps of:

(a) placing a reinforcing grid into a forming bed;
(b) connecting a reinforcing truss to the reinforcing grid;
(c) forming grooves into sidewalls of a buoyant core, wherein the pattern of the grooves corresponds to the pattern of the reinforcing truss;
(d) placing the buoyant core into the forming bed over the reinforcing grid such that the reinforcing truss is positioned in the grooves;
(e) pouring a layer of concrete into the forming bed such that the concrete covers the bottom of the forming bed to form a deck;
(f) filling in the grooves with concrete to embed the truss in the grooves; and
(g) inverting and removing the forming bed.

Step (a) may be preceded by the step of lining the forming bed with a mould liner. Step (d) may be followed by the steps of placing reinforcement bars in grooves formed across a bottom of the buoyant core, and connecting the reinforcement bars to the reinforcement truss.

BRIEF DESCRIPTION OF DRAWINGS

In drawings which show non-limiting embodiments of the invention:

FIG. 10A is a perspective view of the fully constructed version of the embodiment, FIG. 10B is a top plan view of the fully constructed version of the embodiment with inner details shown in dashed lines, FIG. 10C is an upside-down side view of the embodiment in a forming bed, and FIG. 10D is a side view of the fully constructed version of the embodiment with inner details shown in dashed lines.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1A:
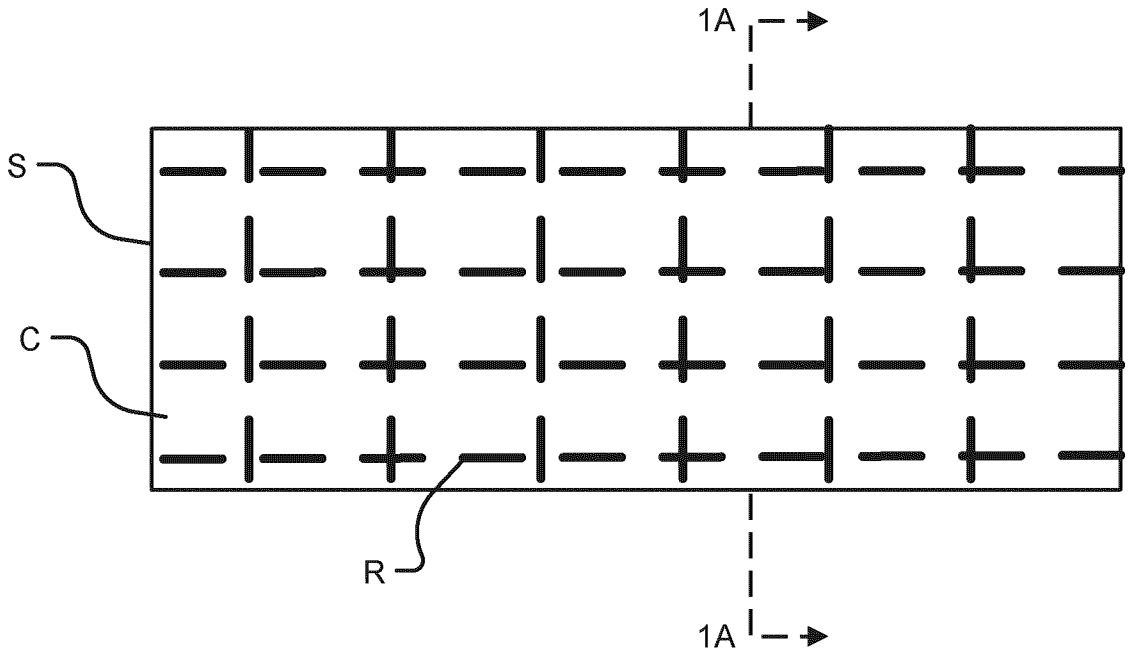
FIG. 1A PRIOR ART
FIG. 1A is a side view of a known floating dock section with inner detail shown in dashed lines.
Figure 1B:
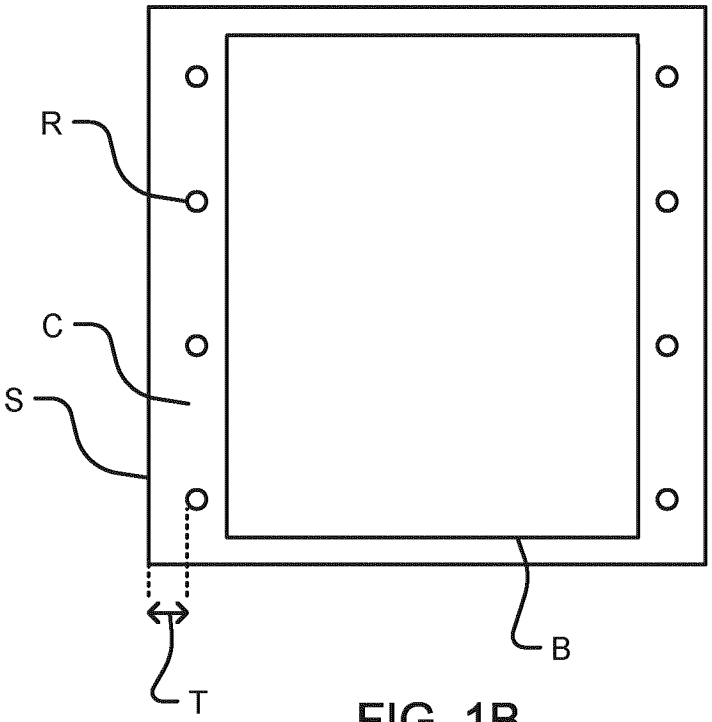
FIG. 1B PRIOR ART
FIG. 1B is a cross-sectional view of the floating dock section shown in FIG. 1 taken along plane 1A-1A.
Figure 2:
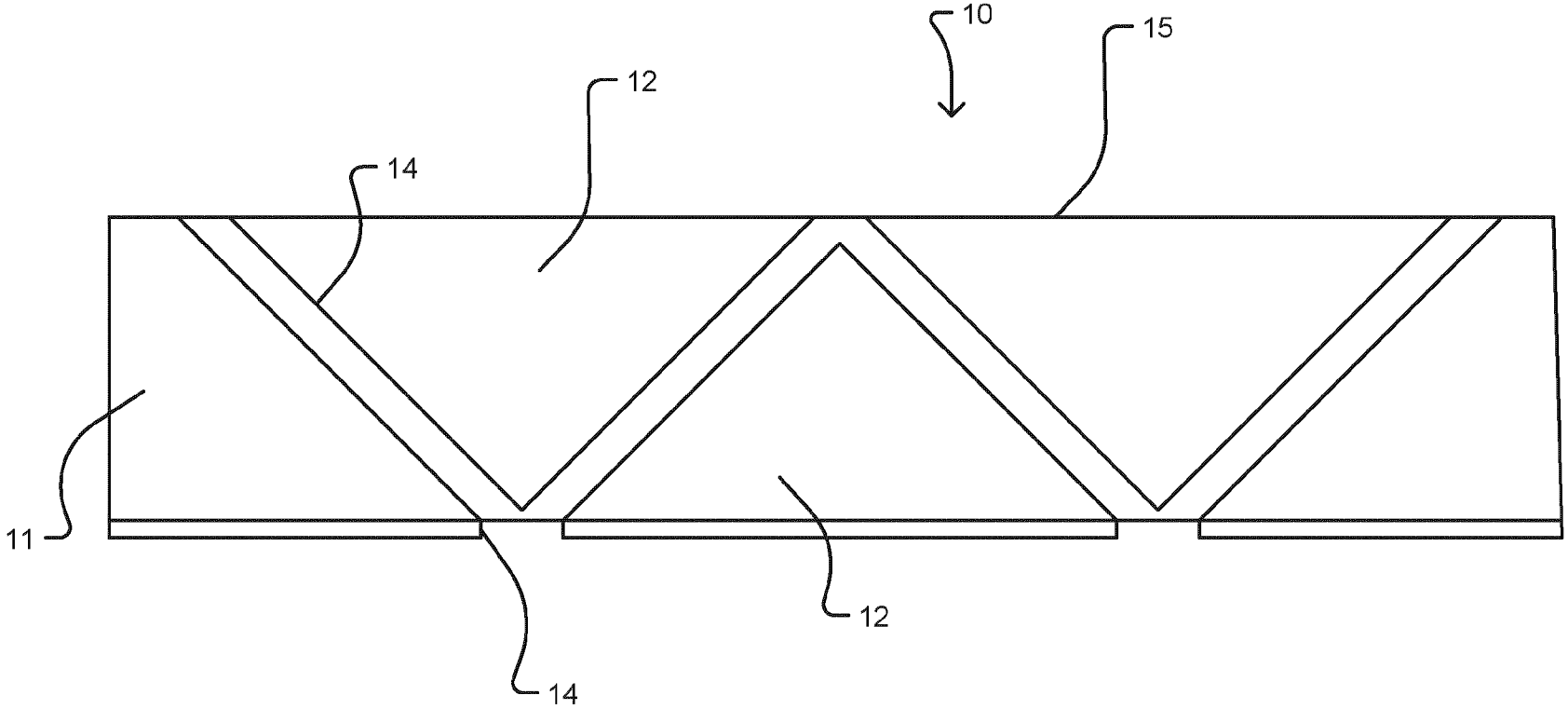
FIG. 2 is a side view of a floating dock section according to one embodiment of the present invention.

FIGS. 1A and 1B show a known floating dock section. Buoyant core B is enveloped in a layer of concrete C. Concrete C is reinforced with rebar R along sidewalls S of the dock section. Rebar R is arranged in a grid pattern and runs along a plane between the surface of buoyant core B and the surface of sidewalls S of the dock section. The thickness T of concrete C between rebar R and the surface of sidewalls S of the dock section is at least three inches (76 mm) to prevent sea water infiltration to, and corrosion of, rebar R. The top and bottom surfaces of core B may also be similarly covered with concrete C reinforced by grids of rebar B.

The present invention provides a lightweight yet durable dock section having rebar trusses set in concrete-filled grooves in the sidewalls of the buoyant core.

FIGS. 2 to 6 show a floating dock section 10 according to one embodiment of the present invention. FIGS. 2 to 5 show dock section 10 with buoyant core 12 exposed. Sidewalls 11 and bottom surface 13 of core 12 have grooves 14. Reinforcing structure 16 is set in grooves 14.

Core 12 may be formed of expanded polystyrene (EPS) foam or any other similar material with sufficient buoyancy for dock section 10 to float and with sufficient firmness to allow grooves 14 to be formed therein. Core 12 may be formed from a single piece of buoyant material or may be formed from multiple smaller pieces of buoyant material. If formed of multiple pieces, the pieces can be assembled prior to grooves 14 being formed or grooves 14 may be formed on the separate pieces. The pieces may also be assembled prior to placing core 12 in a concrete forming bed, or may be assembled in the concrete forming bed itself.

Grooves 14 are of sufficient depth to allow reinforcing structure 16 set therein to be sufficiently spaced apart from the concrete-covered surfaces of dock section 10. In one embodiment, grooves 14 are between 2 to 4 inches (51 to 102 mm) wide and between 2 to 4 inches (51 to 102 mm) deep, and may be 3 inches (76 mm) deep and 3 inches (76 mm) wide. The minimum depth of grooves 14 depend, for example, on the type of concrete used and the environmental conditions of the location where deck section 10 will be used. In some embodiments the grooves may be cut out using a hot wire cutter.

Figure 3:
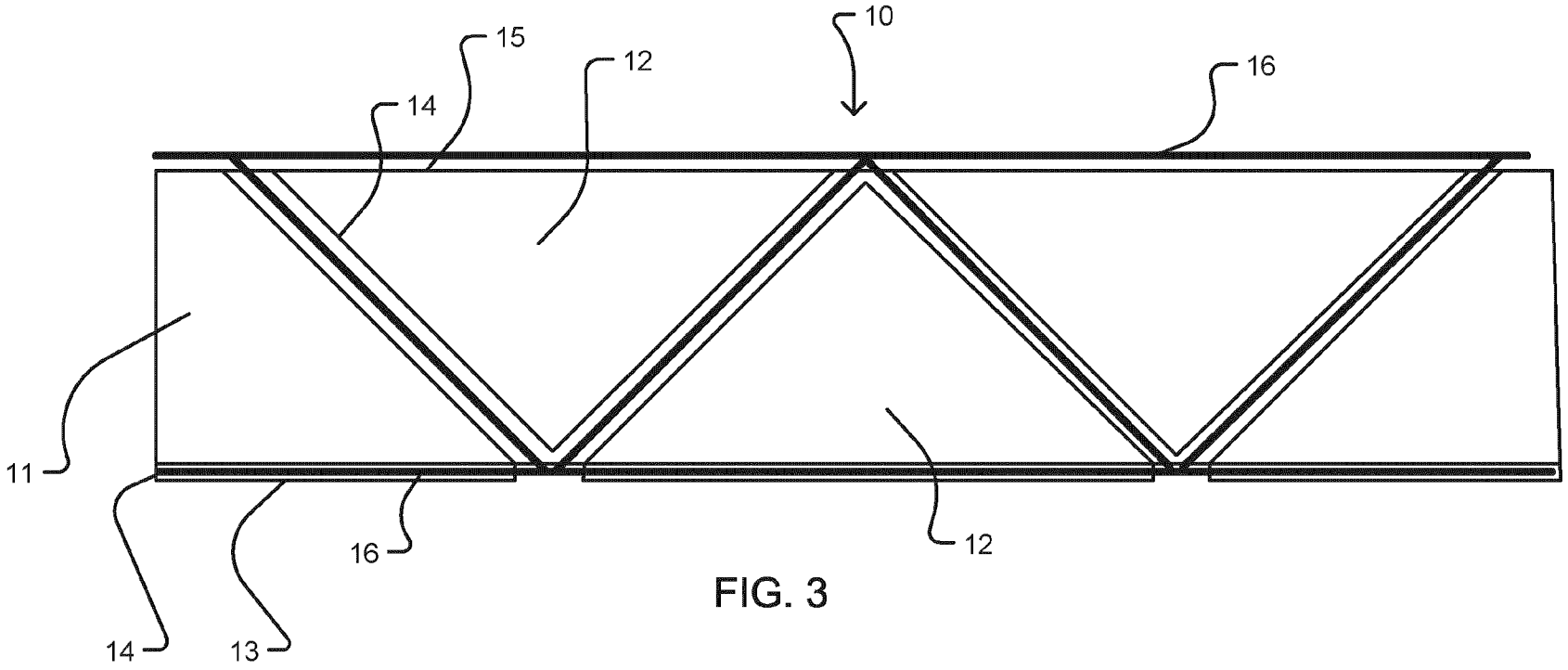
FIG. 3 is a side view of the embodiment shown in FIG. 2.
Figure 4:
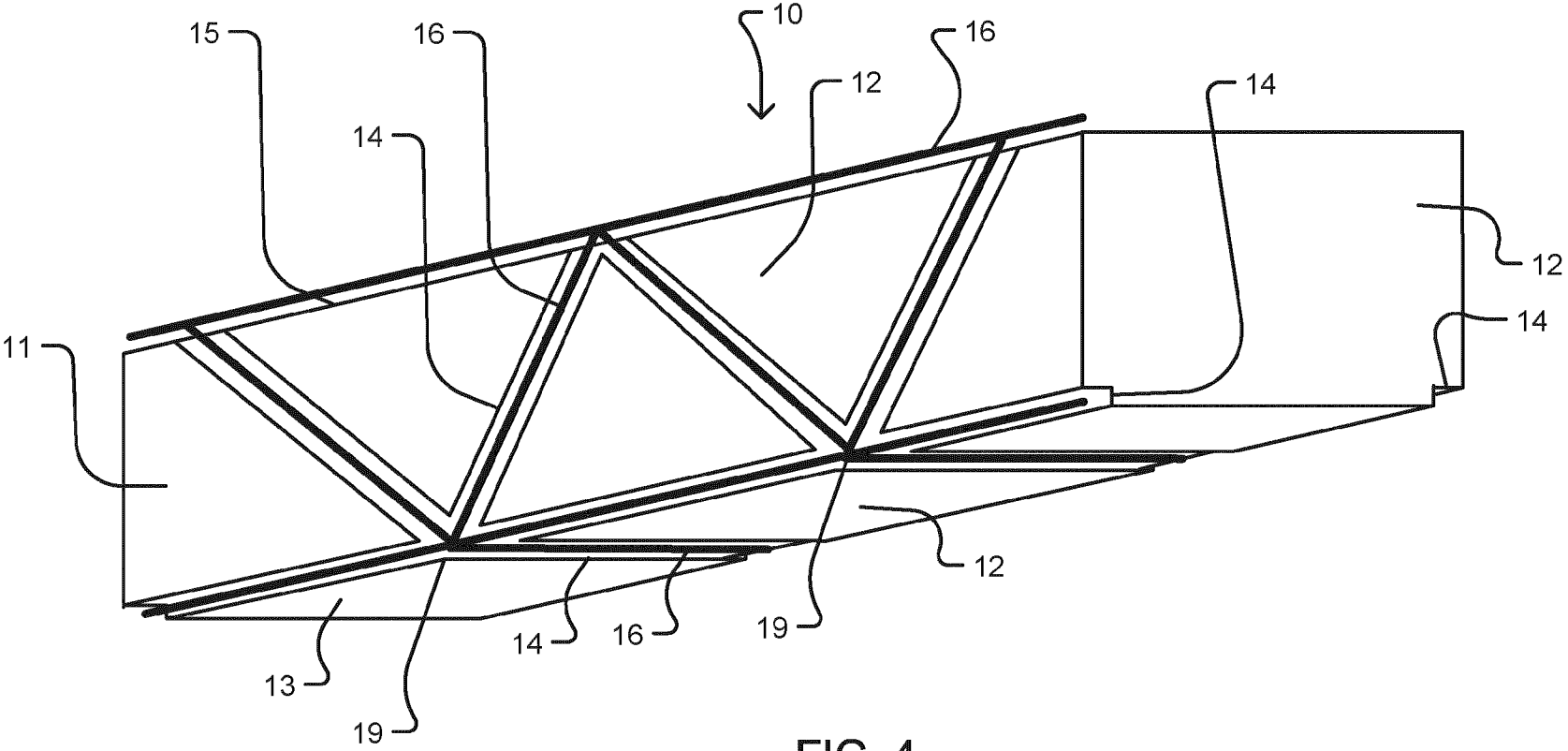
FIG. 4 is a lower perspective view of the embodiment shown in FIG. 2.
Figure 5:
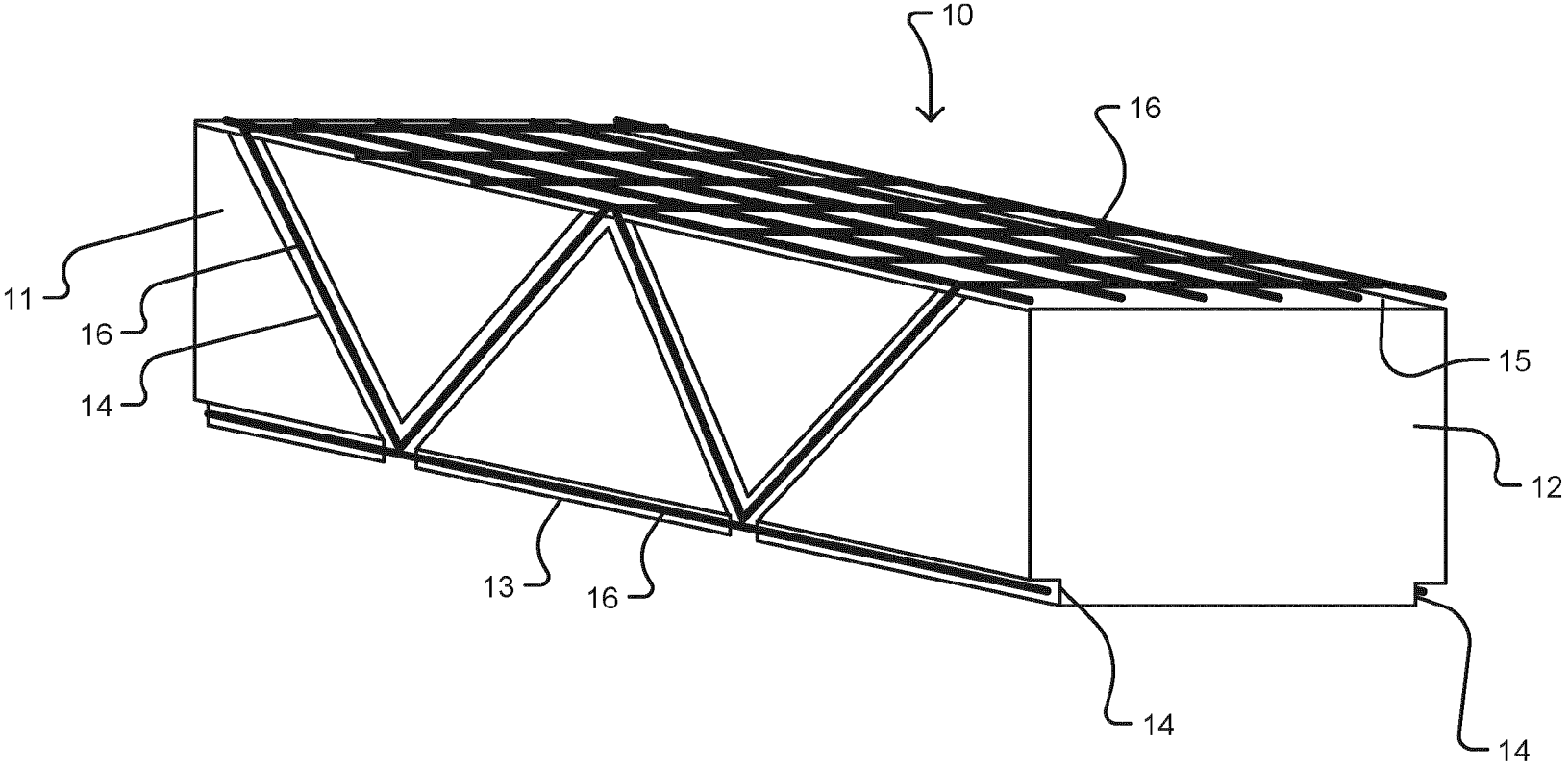
FIG. 5 is an upper perspective view of the embodiment shown in FIG. 2.

FIGS. 3 to 5 show dock section 10 with core 12, grooves 14, and reinforcing structure 16 exposed. Reinforcing structure 16 is set in grooves 14 along sidewalls 11 and bottom surface 13 of core 12. Reinforcing structure 16 may also extend to top surface 15 of core 12 in a grid pattern to reinforce concrete deck 17, as best shown in FIGS. 5 and 6. Reinforcing structure 16 is made from steel reinforcement bars (rebar). In other embodiments, reinforcing structure 16 may be made from any other suitable material of similar strength to rebar.

Grooves 14 and reinforcing structure 16 along sidewalls 11 may be patterned in a simple truss as shown in the embodiment in FIGS. 2 to 6. In other embodiments, grooves 14 and reinforcing structure 16 may be patterned in any type of truss sufficient to resist downward forces due to weight placed on deck 17 of dock section 10. Other types of trusses include but are not limited to Howe, Warren, Pratt, King post, Fink, Vierendeel, palladian, lattice and grid trusses. FIG. 7 for example shows an alternative embodiment in dock section 100 wherein core 112 has grooves 114 patterned in a lattice truss.

Grooves 14 and reinforcing structure 16 cross laterally along bottom surface 13 and join grooves 14 and reinforcing structure 16 along sidewalls 11 at nodes 19. In other embodiments, grooves 14 and reinforcing structure 16 along bottom surface 13 may be patterned in a truss. In yet other embodiments, grooves 14 and reinforcing structure 16 may be absent along bottom surface 13.

Figure 6A:
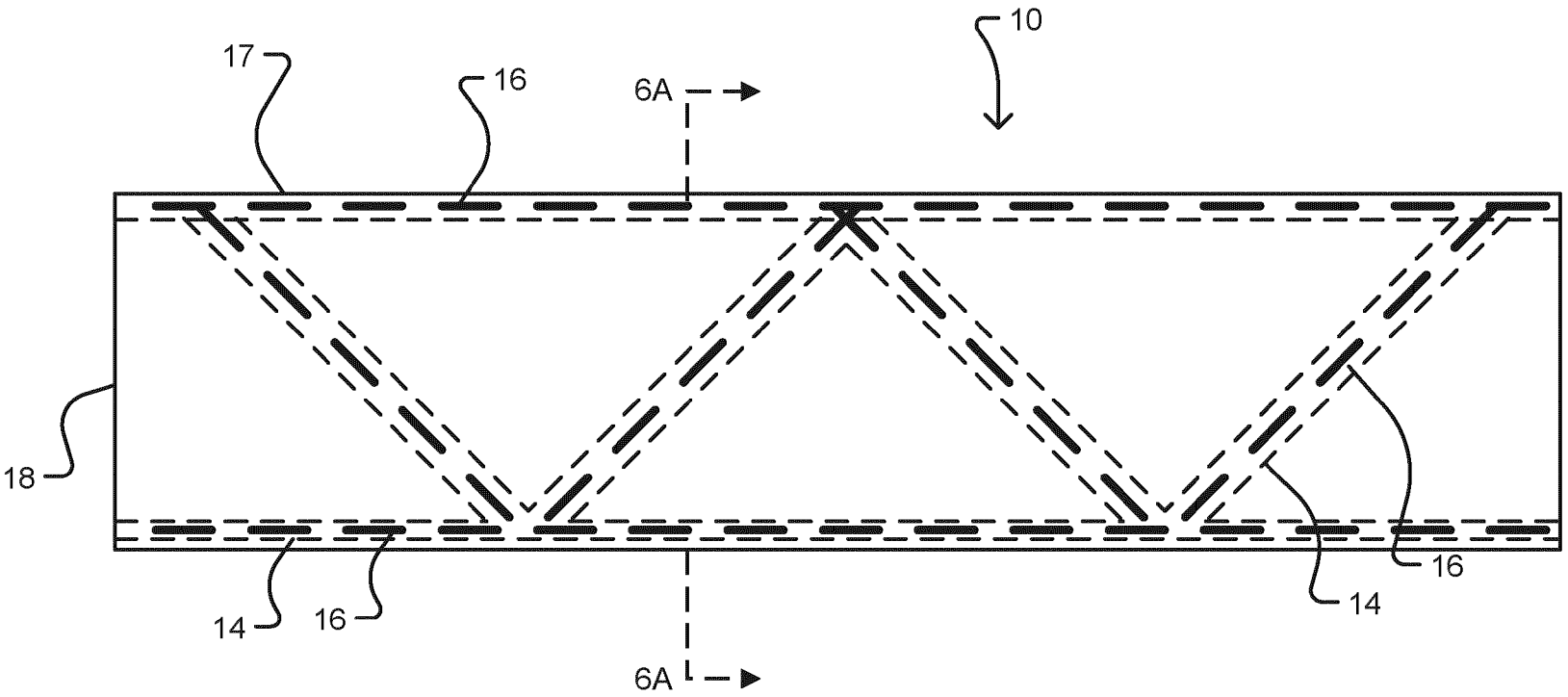
FIG. 6A is a side view of the embodiment shown in FIG. 2 with inner detail shown in dashed lines.
Figure 6B:
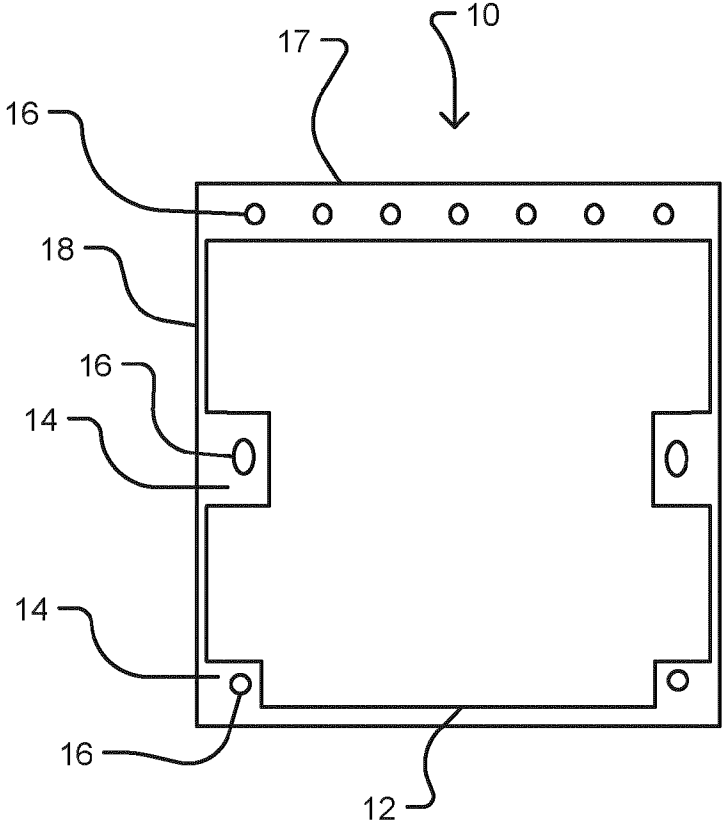
FIG. 6B is a cross-sectional view of the embodiment shown in FIG. 2 taken along plane 6A-6A.
Figure 7:
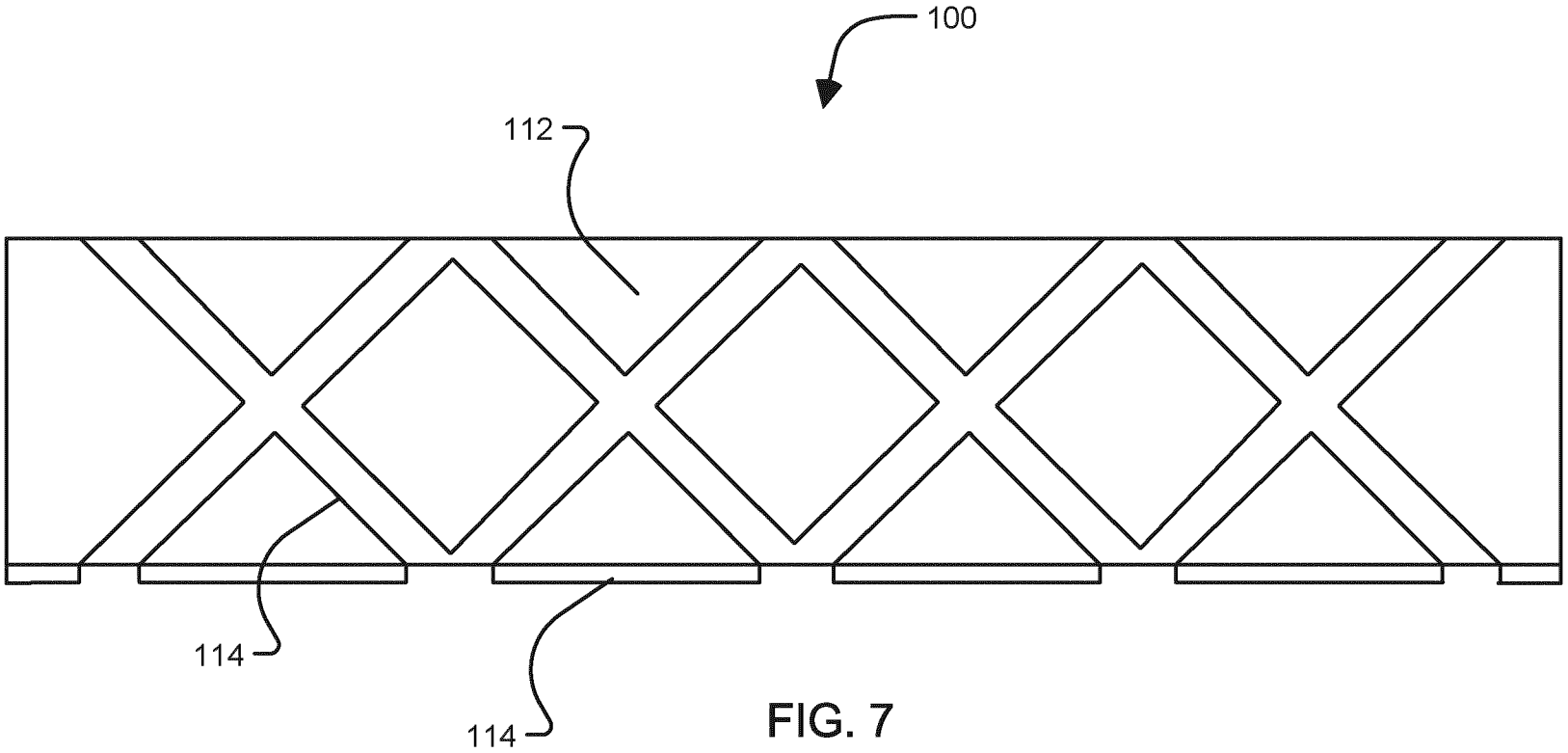
FIG. 7 is a side view of a floating dock section according to another embodiment of the present invention.

FIGS. 6A and 6B show a completed dock section 10 covered by concrete 18. The term "concrete" as used throughout this specification includes concrete and materials similar to concrete such as grout, mortar and the like. In other embodiments the dock section may be covered with polyurethane or polyurea hybrid coatings such as Rhino™ liner or Rebel™ coating. As shown in FIG. 6B, reinforcing structure 16 is embedded in concrete 18 in grooves 14, suitably spaced (e.g., spaced at least 3 inches (76 mm) away) from the outer surfaces of deck section 10 which may be exposed to sea water. Concrete material costs are minimized by filling in grooves 14 with concrete instead of applying a minimum 3 inch (76 mm) thick layer of concrete over all of sidewalls 11 and bottom surface 13 of the core. In the embodiment shown, a thin layer of concrete is applied over all of sidewalls 11 and bottom surface 13 after grooves 14 are filled in. In some embodiments the covering (e.g. concrete) may be ¼ inch to 1 inch (6 mm to 25 mm) thick. In other embodiments, the covering may be thicker than 1 inch (25 mm). The thickness of the covering may in part be dictated by environmental conditions for which the dock section is designed. In other embodiments, the thin layer of concrete 18 may not be applied at all, or may be substituted with some other durable, waterproof coating.

Figure 8B:
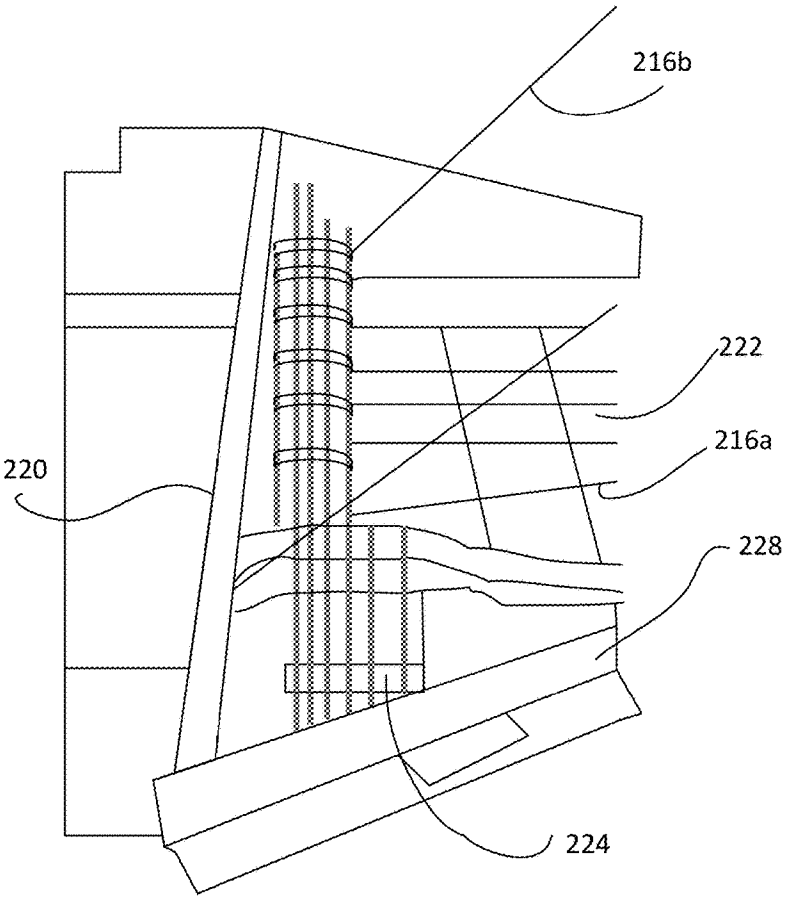
FIGS. 8A to 8C are photographs of a forming bed and reinforcing structure of a floating dock section according to another embodiment of the invention.
Figure 8A:
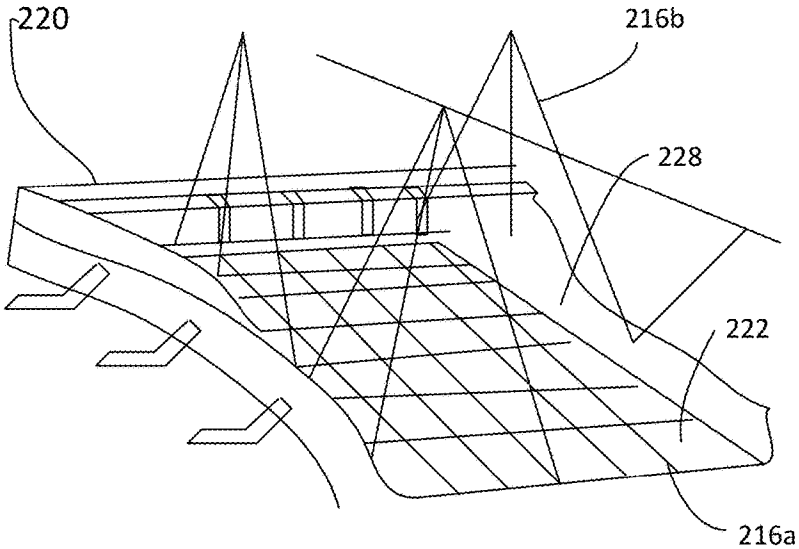
Figure 8C:
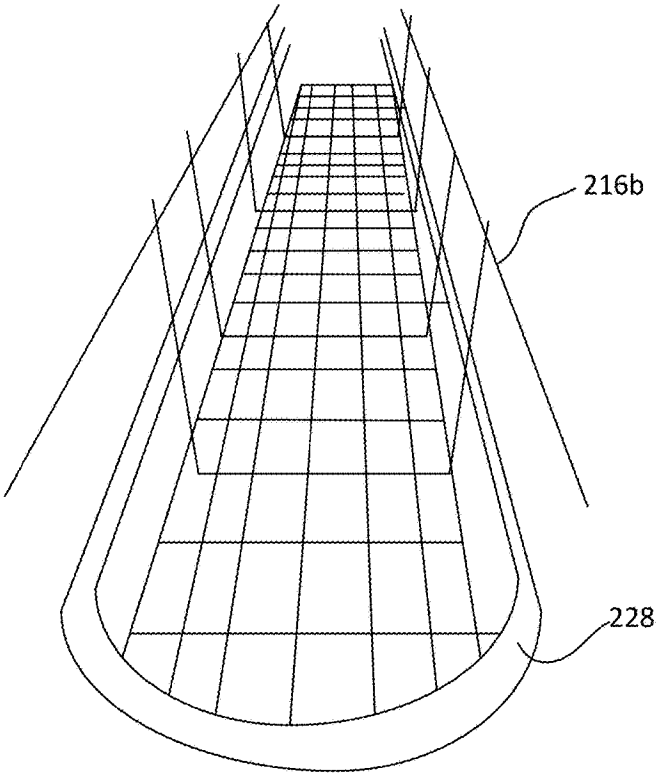

A dock section 200 according to another embodiment of the invention may be constructed as shown in FIGS. 8 and 9. Grooves 214 along sidewalls 211 and bottom surface 213 are formed in buoyant core 212. A forming bed 220 for the deck of dock section 200 is formed, as shown in FIGS. 8A to 8C. Forming bed 220 may include a rubrail 228 and a mould liner 222. Mould liner 222 provides texture to the top surface of the deck. Forming bed 220 may also include forms 224 for forming dock connector ports for use in linking dock section 200 with another dock section with a dock connectors. The dock connector could for example be a shock-absorbing connector as described in Canadian patent No. 1310210 issued 17 Nov. 1992.

Figure 9B:
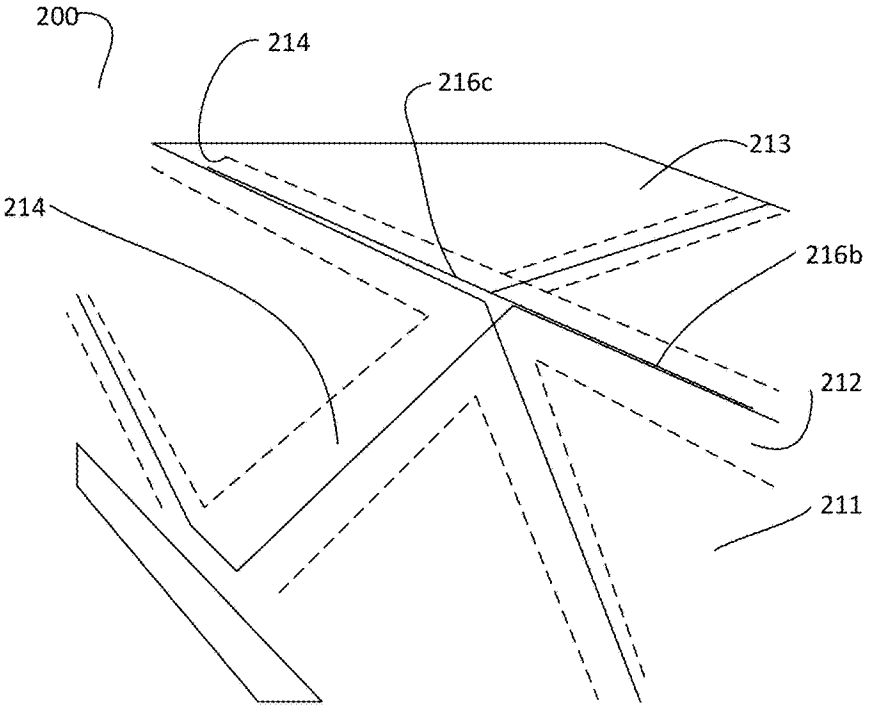
FIGS. 9A and 9B are photographs of the forming bed, reinforcing structure and a core of the embodiment shown in FIGS. 8A to 8C.
Figure 9A:
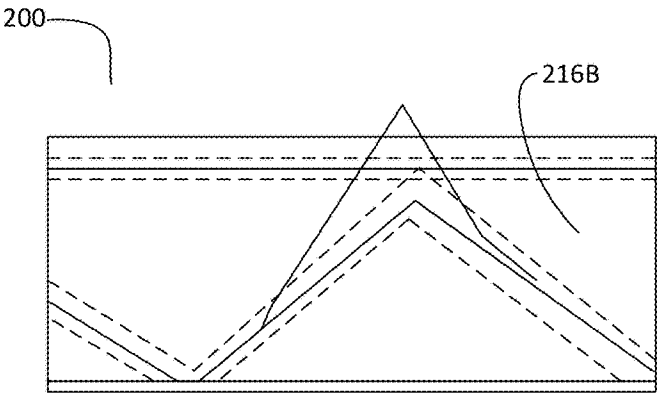
Figure 10A:
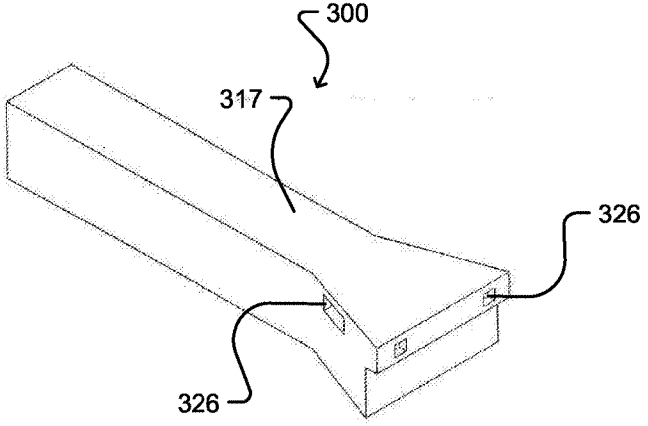
FIGS. 10A to 10D are views of a floating dock section according to another embodiment of the present invention, where
Figure 10B:
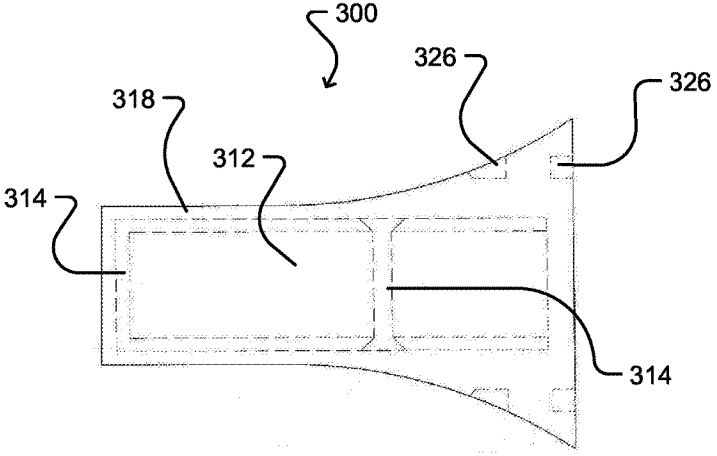
Figure 10C:
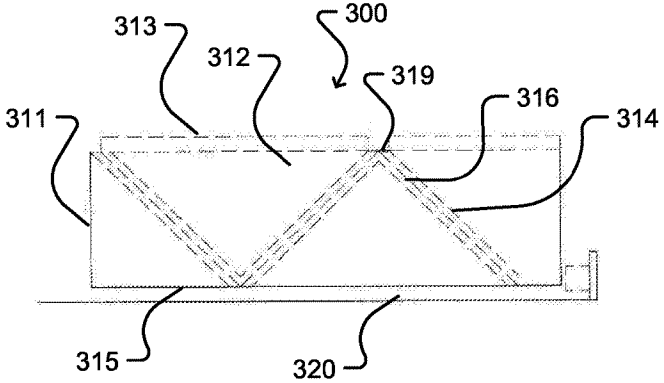
Figure 10D:
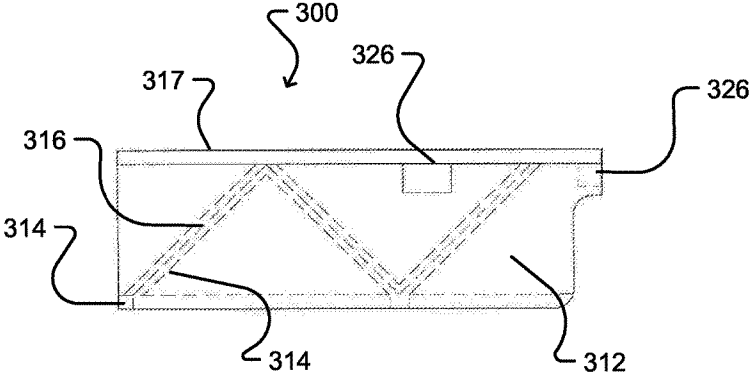

A reinforcing grid 216*a* and reinforcing truss 216*b* are formed and placed in forming bed 220, as best shown in FIG. 8C. Core 212 is then placed into forming bed 220 so that reinforcing truss 216*b* is set in grooves 214 of sidewall 211 of core 212, as shown in FIGS. 9A and 9B. Reinforcement bars 216*c* may be set in grooves 214 across bottom surface 213 and may be connected to reinforcement truss 216*b*, as shown in FIG. 9B.

The deck of dock section 200 is formed by pouring concrete into forming bed 220. Concrete is sprayed, poured or otherwise applied to fill in grooves 214 of sidewalls 211 and bottom surface 213. Grooves 214 of core 212 function as formwork for the concrete to embed reinforcement truss 216*b* and reinforcement bars 216*c*. The remaining sections of sidewalls 211 and bottom surface 213 may optionally be sprayed or covered with a layer of concrete of other durable waterproof material. The thickness of this layer may depend on the environmental conditions of the location where dock section 200 will be used. Forming bed 220 and dock section 200 are then inverted, and forming bed 220 removed from the deck, to complete dock section 200. Dock section 200 can support a 8800 lb (3992 kg) weight on its deck.

A dock section 300 according to another embodiment of the invention is shown in FIGS. 10A to 10D. Sidewalls 311, buoyant core 312, bottoms surface 313, grooves 314, top surface 315, reinforcing structure 316, deck 317, concrete 318, node 319, forming bed 320, and dock connector 326 have structures and functions similar to the corresponding parts described previously described above for dock sections 10 and 200.

As will be apparent to those skilled in the art in the light of the foregoing disclosure, many alterations and modifications are possible in the practice of this invention without departing from the spirit or scope thereof.

Accordingly, the scope of the invention is to be construed in accordance with the substance defined by the following claims.

The invention claimed is:

1. A floating dock comprising:

a buoyant core having sidewalls with concrete-filled grooves spanning and traversing the height of the sidewalls; and a reinforcing truss embedded in and extending along a path defined by concrete-filled grooves.

2. A floating dock according to claim 1 wherein the reinforcing truss comprises reinforcement steel bars.

3. A floating dock according to claim 2 wherein the concrete-filled grooves are approximately 2 to 4 inches (50.8 to 101.6 mm) deep.

4. A floating dock according to claim 3 wherein the concrete-filled grooves are approximately 3 inches (76.2 mm) deep.

5. A floating dock according to claim 3 wherein the reinforcing truss is selected from the group consisting of simple, lattice, Howe, Warren, Pratt, King post, Fink, Vierendeel, palladian, and grid trusses.

6. A floating dock according to claim 5 wherein the reinforcing truss is a simple truss.

7. A floating dock according to claim 1 wherein the buoyant core comprises expanded polystyrene foam.

8. A floating dock according to claim 7 wherein the buoyant core is shaped as a rectangular prism.

9. A floating dock according to claim 7 wherein the buoyant core having a bottom with concrete-filled grooves, and reinforcement steel bars embedded in and extending through the concrete-filled grooves of the bottom.

10. A floating dock according to claim 7 wherein the reinforcement steel bars embedded in and extending through the concrete-filled grooves of the bottom connect to the reinforcement steel bars embedded in and extending through the concrete-filled grooves of the sidewalls.

11. A floating dock according to claim 10 comprising a deck.

12. A floating dock according to claim 11 wherein the deck comprises concrete reinforced with a grid of reinforcement steel bars.

13. A floating dock according to claim 12 wherein the grid of reinforcement steel bars reinforcing the concrete of the deck connects to the reinforcement steel bars embedded in and extending through the concrete-filled grooves of the sidewalls.

14. A floating dock according to claim 13 comprising connectors for connecting to one or more other floating docks.

15. A floating dock according to claim 14 wherein the connectors comprise a pair of parallel channels formed at one end of the floating dock.

16. A method of constructing a floating dock comprising the steps of:

(a) lining the forming bed with a mould liner;

(b) placing a reinforcing grid into a forming bed;

(c) connecting a reinforcing truss to the reinforcing grid;

(d) forming grooves into sidewalls of a buoyant core, wherein the pattern of the grooves corresponds to the pattern of the reinforcing truss;

(e) placing the buoyant core into the forming bed over the reinforcing grid such that the reinforcing truss is positioned in the grooves;

(f) placing reinforcement bars in grooves formed across a bottom of the buoyant core;

(g) connecting the reinforcement bars to the reinforcement truss;

(h) pouring a layer of concrete into the forming bed such that the concrete covers the bottom of the forming bed to form a deck;

(i) filling in the grooves with concrete to embed the truss in the grooves; and (j) inverting and removing the forming bed.

* * * * *